US012607111B2

(12) United States Patent
Tayla et al.

(10) Patent No.: US 12,607,111 B2
(45) Date of Patent: Apr. 21, 2026

(54) AUTONOMOUS STEERING FOR DIRECTIONAL DRILLING WITH COLLISION AVOIDANCE

(71) Applicant: Halliburton Energy Services, Inc., Houston, TX (US)

(72) Inventors: Shashishekara Sitharamar Tayla, Houston, TX (US); Pete L. Schiermeier, Houston, TX (US); Aniket Sanyal, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/074,459

(22) Filed: Dec. 3, 2022

(65) Prior Publication Data

US 2023/0383638 A1 Nov. 30, 2023

Related U.S. Application Data

(60) Provisional application No. 63/345,674, filed on May 25, 2022.

(51) Int. Cl.
*E21B 44/00* (2006.01)
*E21B 7/04* (2006.01)
(Continued)

(52) U.S. Cl.
CPC ..... *E21B 44/00* (2013.01); *E21B 7/04* (2013.01); *E21B 7/06* (2013.01); *E21B 7/10* (2013.01); *E21B 2200/20* (2020.05)

(58) Field of Classification Search
CPC ..... E21B 44/00; E21B 7/06; E21B 2200/20; E21B 44/005; E21B 7/04; E21B 7/10
See application file for complete search history.

(56) References Cited

U.S. PATENT DOCUMENTS 6,308,787 B1 * 10/2001 Alft ..... E21B 7/065 175/48
7,152,696 B2 12/2006 Jones
(Continued)

FOREIGN PATENT DOCUMENTS

CA 2961347 A1 7/2016
CA 3008602 A1 6/2017
(Continued)

*Primary Examiner* — Brad Harcourt
(74) *Attorney, Agent, or Firm* — Benjamin Ford; Parker Justiss, P.C.

(57) ABSTRACT

The disclosure provides an automated method and autonomous steering system that automates and integrates a collision avoidance process and subsequent corrective action. The autonomous steering system implements an anti-collision (AC) method that provides collision avoidance by identifying collision risks with one or more hazards. In one example, the automated method includes: (1) detecting a collision risk of a path of a wellbore in a subterranean formation with at least one hazard, wherein the wellbore is being drilled by steering a downhole drilling tool according to the path and the path is based on a well plan for the wellbore, (2) identifying a corridor for the wellbore to avoid the at least one hazard, (3) modifying the path by incorporating the corridor, and (4) steering the downhole drilling tool according to the modified path, wherein the detecting, the identifying, the modifying, and the steering are automatically performed in real-time.

20 Claims, 5 Drawing Sheets

(51) Int. Cl.
*E21B 7/06* (2006.01)
*E21B 7/10* (2006.01)

(56) References Cited

U.S. PATENT DOCUMENTS

| | | | | |
|---|---|---|---|---|
| 9,068,432 | B2 | 6/2015 | Chapman | |
| 10,961,837 | B2 * | 3/2021 | Gillan | E21B 47/022 |
| 11,015,433 | B2 | 5/2021 | Li et al. | |
| 11,085,283 | B2 | 8/2021 | Beeson et al. | |
| 2002/0103630 | A1 * | 8/2002 | Aldred | E21B 44/00 703/10 |
| 2010/0271232 | A1 | 10/2010 | Clark et al. | |
| 2011/0079431 | A1 | 4/2011 | Clark | |
| 2015/0090496 | A1 * | 4/2015 | Rempe | G01V 3/30 175/45 |
| 2016/0090822 | A1 * | 3/2016 | Lu | E21B 7/10 703/1 |
| 2017/0002650 | A1 * | 1/2017 | Greenwood | E21B 7/04 |
| 2018/0051552 | A1 * | 2/2018 | Li | E21B 47/024 |
| 2019/0032472 | A1 | 1/2019 | Ahmadi Kalateh Ahmad et al. | |
| 2020/0011158 | A1 | 1/2020 | Xu et al. | |
| 2020/0040724 | A1 | 2/2020 | Djefel | |
| 2020/0248545 | A1 | 8/2020 | Maus et al. | |
| 2020/0256181 | A1 | 8/2020 | Jamieson et al. | |
| 2020/0378248 | A1 | 12/2020 | Maus et al. | |
| 2021/0162896 | A1 | 6/2021 | Duplantis et al. | |

FOREIGN PATENT DOCUMENTS

| | | | |
|---|---|---|---|
| WO | 2018090348 | A1 | 5/2018 |
| WO | 2021007194 | A1 | 1/2021 |

* cited by examiner

AUTONOMOUS STEERING FOR DIRECTIONAL DRILLING WITH COLLISION AVOIDANCE

CROSS-REFERENCE TO RELATED APPLICATION

This application claims the benefit of U.S. Provisional Application Ser. No. 63/345,674, filed by Shashishekara Sitharamar Talya, et al. on May 25, 2022, entitled "AUTONOMOUS STEERING FOR DIRECTIONAL DRILLING WITH COLLISION AVOIDANCE," which is commonly assigned with this application and incorporated herein by reference in its entirety.

TECHNICAL FIELD

The disclosure generally relates to wellbore drilling and more particularly, to automatically controlling directional drilling and avoiding collisions.

BACKGROUND

Directional drilling requires accurate steering of a bottom hole assembly (BHA) while considering multiple inputs, such as surveys, real-time inclination and azimuth, steering tool yield etc. and multiple constraints such as maximum allowable dogleg severity, and proximity to adjacent wells. One of the safety critical aspect of steering that is done in real-time is monitoring proximity to adjacent wells, which can be performed by collision avoidance systems. The collision avoidance systems used in the industry are a manual process that requires a directional driller to check with the collision avoidance system at survey points to ensure there is adequate clearance between a current well being drilled and an existing adjacent well or wells. The collision avoidance process requires the directional driller to perform a project ahead to a pre-specified distance and check for collisions. In case the directional driller determines that there is risk of collision with an adjacent well, there is a pre-specified escalation mechanism that might require defining a new well path to steer away from the adjacent well.

SUMMARY

In one aspect, the disclosure provides an automated method of drilling a wellbore. In one example, the method includes: (1) detecting a collision risk of a path of a wellbore in a subterranean formation with at least one hazard, wherein the wellbore is being drilled by steering a downhole drilling tool according to the path and the path is based on a well plan for the wellbore, (2) identifying a corridor for the wellbore to avoid the at least one hazard, (3) modifying the path by incorporating the corridor, and (4) steering the downhole drilling tool according to the modified path, wherein the detecting, the identifying, the modifying, and the steering are automatically performed in real-time.

In another aspect, the disclosure provides an autonomous steering system. In one example, the autonomous steering system, comprises: (1) an interface to receive well data, and (2) one or more processor to perform operations that include: (2A) detecting a collision risk of a path of a wellbore in a subterranean formation with at least one hazard, wherein the wellbore is being drilled by steering a downhole drilling tool according to the path and the path is based on a well plan for the wellbore, (2B) identifying a corridor for the wellbore to avoid the at least one hazard, (2C) modifying the path by incorporating the corridor, and (2D) steering the downhole drilling tool according to the modified path, wherein one or more of the detecting, the identifying, the modifying, and the steering are automatically performed in real-time.

In yet another aspect, the disclosure provides a computer program product having a series of operating instructions stored on a non-transitory computer readable medium that direct the operation of a processor when initiated to perform operations. In one example the operations include: (1) detecting a collision risk of a path of a wellbore in a subterranean formation with at least one hazard, wherein the wellbore is being drilled by steering a downhole drilling tool according to the path and the path is based on a well plan for the wellbore, (2) identifying a corridor for the wellbore to avoid the at least one hazard, (3) modifying the path by incorporating the corridor, and (4) steering the downhole drilling tool according to the modified path, wherein one or more of the detecting, the identifying, the modifying, and the steering are automatically performed in real-time.

BRIEF DESCRIPTION

Reference is now made to the following descriptions taken in conjunction with the accompanying drawings, in which.

Figure 4:
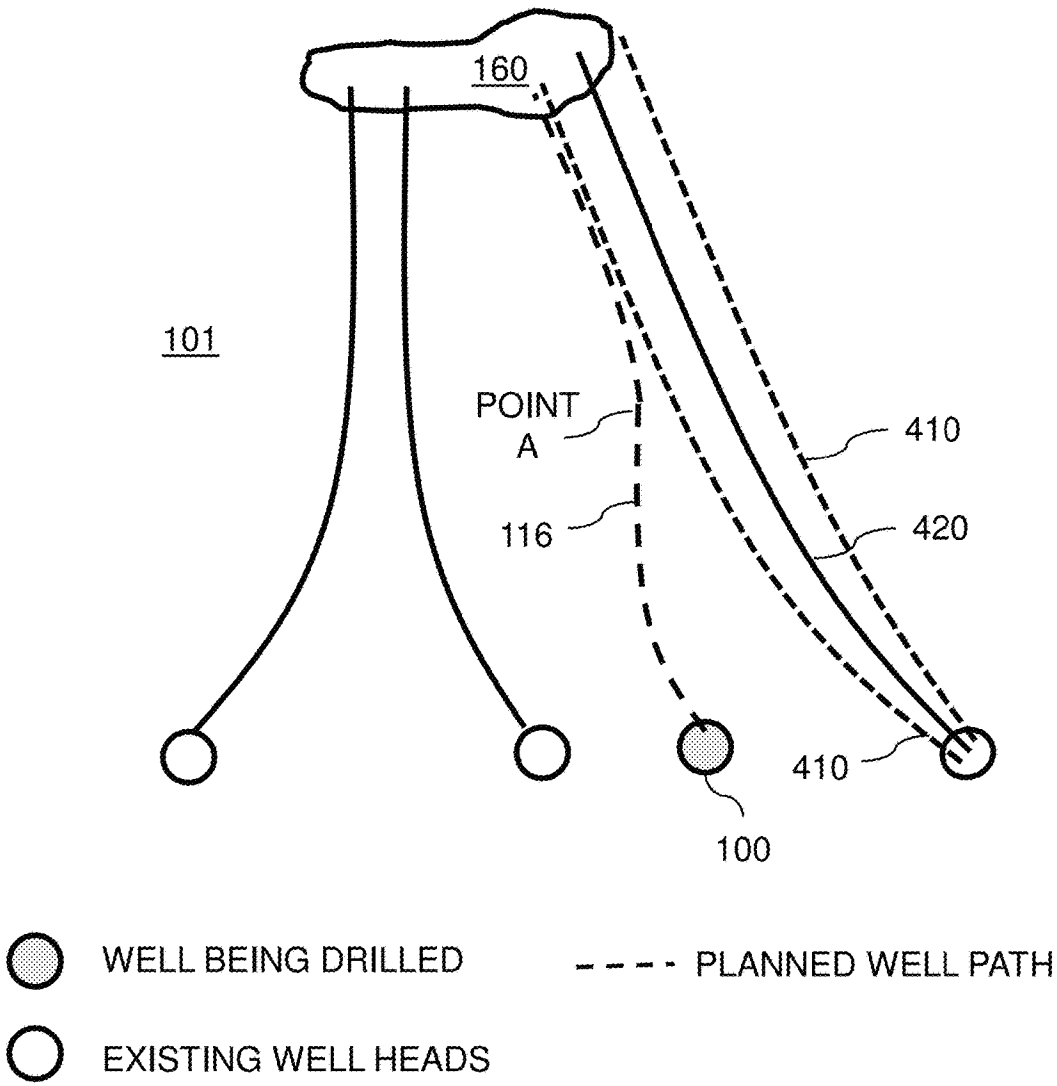
Figure 5:
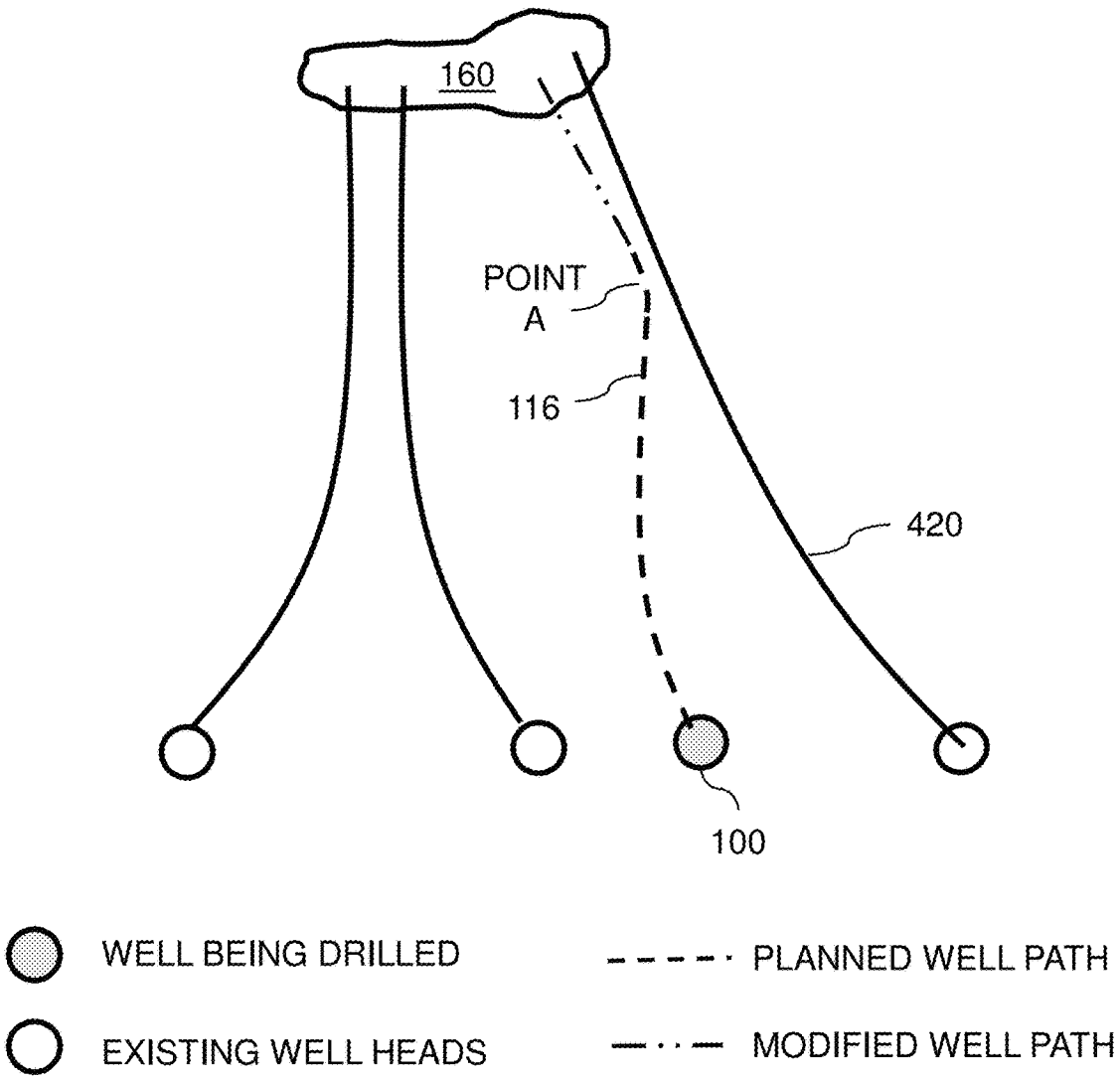

FIG. 4 illustrates an overhead view of an example of a cluster of existing wells and a representative well, which is in the process of being drilled from the surface to a target zone in a subterranean formation according to the automated drilling principles of the disclosure; and FIG. 5 illustrates another overhead view of the example of existing wells and a representative well and a representative well, which is in the process of being drilled from the surface to a target zone in a subterranean formation according to the automated drilling principles of the disclosure.

DETAILED DESCRIPTION

The disclosure provides an improved autonomous steering system that automates and integrates a collision avoidance process and subsequent corrective action. The autonomous steering system will automatically generate a new well path, i.e., a modified well path, when there is a risk of a collision with an adjacent well or another hazard, thus eliminating the need for a directional driller to manually intervene and perform this task. The autonomous steering system can be an autonomous steering platform that combines physics-based models and machine learning to modify a well path to avoid collisions and then automatically steer a downhole drilling tool according to the modified well path. The downhole drilling tool can be, for example, a directional drilling BHA equipped with a mud motor or a rotary steerable system (RSS), or another type steerable drill bit.

The disclosed autonomous steering system provides many advantages including an engineering solution for a safety critical aspect of drilling instead of relying on a human/ process based solution as with conventional systems. By automating and incorporating real-time well path changes, a well can be delivered faster, eliminating the wait time and manual calculation time for avoiding hazards. In addition to making faster decisions resulting in reduced well delivery time, a smoother wellbore can also be drilled that allows for faster casing runs.

A hazard can be a foreign or man-made hazard, such as an adjacent or offset well, fish, broken BHA, casing, or another underground barrier to avoid. A hazard can also be a natural or geological hazard, such as a geological fault. In addition to man-made and geological hazards, a hazard can also be defined, such as a constraint. A buffer zone around an area of concern, such as a fault, is an example of constraint that can be defined. Modifying the well path can be based on the type of hazard. The hazards can be classified into different categories, such as soft and hard hazards, wherein modifying of the well path is based according to the type of hazard category. For example, the hazards can be classified as soft hazards, such as a buffer zone, and hard hazards, such as an existing well. For a hard hazard, the path can be modified by performing a hard steer away to ensure no collision. For a soft hazard, the path could be slightly modified or unmodified and monitored closely before making a decision to modify.

The disclosed autonomous steering system implements an anti-collision (AC) method that provides collision avoidance by identifying collision risks with one or more hazards. As drilling conditions change, well positioning can be affected and result in nearby wellbores creating a concern for drilling. The disclosed method defines a "safe to drill" corridor and automatically steers the downhole drilling tool using the well plan, real-time wellbore positioning, and the corridor to avoid collisions. The downhole drilling tool can use a project ahead feature for identifying separation factors (SF) in relation to the downhole drilling tool and a SF offset can be used for determining the safe corridor. The SF offset can be input by an engineer for different drilling jobs. A safe corridor considers the SF offset and can be located within an area that is outside of the "ellipses" of adjacent well, wherein the center-to-center (C to C) distance with offset could be taken into consideration to determine a safe corridor. The ellipses can correspond to a buffer zone that is defined, such as by the engineer. The well path can then be modified according to the corridor to clear the area of concern (i.e., a hazard) and get the wellbore back on the planned well path (e.g., well path defined in the well plan). Modification of the well path can be based on the type of hazard. The disclosed correction method will identify change in actual trajectory, offset well location, planned well path, and flag/alert the user as to any risks that are seen and what is the plan change that is being calculated. The method can provide a visual representation for the user that shows the alerts, risks, planned well path, and modified well path. The visual representation can be presented on a screen, such as screen 218 of FIG. 2.

The project ahead feature can be a nearby well scan that provides a radial scan to assist in identifying the safe corridor. Conventional systems can be used to make the scan. The radial scan can be used to identify different drilling zones that correlate to collision risks. The different drilling zones can be three hardline zones of drilling concerns, a green zone which is clear to drill or corridor to drill too, a yellow zone for caution and to react to AC concerns to steer away from, and an amber/red zone for stop drilling and monitor while drilling scenario and drilling trajectory changes. FIG. 4 illustrates an example of yellow zone collision risk and FIG. 5 illustrates an example of a red zone collision risk. The method automatically steers away from the area of concern to a safe corridor corresponding to the green zone in order to deviate the planned well path from the collision concern.

Figure 1:
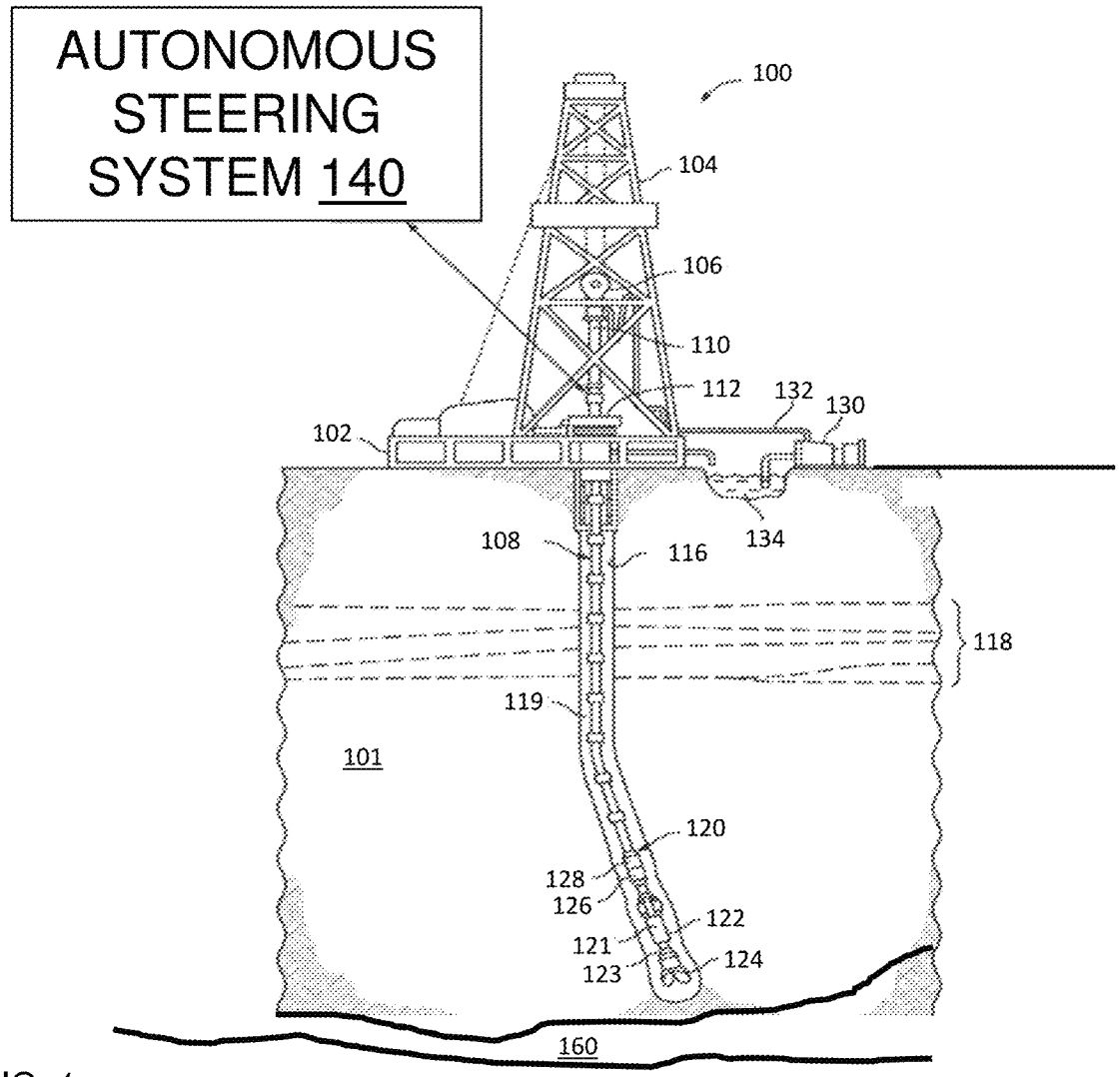
FIG. 1 illustrates a system diagram of an example of a well system constructed to drill a well according to the principles of the disclosure.

FIG. 1 illustrates a system diagram of an example of a well system 100 constructed to drill a well according to the principles of the disclosure. The well system 100 represents retrieving hydrocarbons, such as oil and gas, on land. The disclosed processes and systems can also be used with other subterranean drilling applications including: geothermal wellbores, water wells, boreholes for mineral extraction, etc. Data from one or more proximate existing wells (e.g., offset wells), such as shown in FIGS. 4 and 5, may be used while drilling the well to avoid collisions. Additionally, the method used for drilling the well will communicate and use surveys taken in real-time with the well path within the rig machine, data from a directional well path planning application, such as from COMPASS directional path planning software available from Halliburton of Houston, Texas, and directional software being utilized to store the surveys in a database in order to make a suggested plan to change the well path and populate the change and compare anti-collision (AC) scans from the planned well plan as well as pull the log of real-time survey data to populate databases as they happen (at stand and intervals in between (continuous measurements)). Alternatively, the method can obtain an output file giving offset well information, such as an .adp file, and an output file providing boundaries of the planned well path according to the well plan for well, such as an Extensible Markup Language (xml) file, .xml file, that is refreshed based on the proposed trajectory change for the well so the software method can accurately track offset wells with well path design changes if real-time updates cannot occur. An adp.file is a Microsoft Access project file that provides a connection to a Microsoft SQL server database. Another similar type of file can be used.

The well system 100 includes a drilling platform 102 that supports a derrick 104 having a traveling block 106 for raising and lowering a drill string 108. A kelly 110 supports the drill string 108 as the drill string 108 is lowered through a rotary table 112. A top drive (not illustrated) can be used to rotate the drill string 108.

The well system 100 also includes a downhole drilling tool 120 disposed in a directional wellbore 116 that extends into subterranean formation 101. The downhole drilling tool 120 can be a directional drilling BHA equipped with a mud motor or RSS) or another type steerable drill bit. The downhole drilling tool 120 includes a downhole motor 121 and a drill bit 124 that is positioned at the downhole end of the downhole drilling tool 120. The drill bit 124 may be driven by the downhole motor 121 and/or rotation of the drill string 108 from the surface. As the drill bit 114 rotates, the drill bit 114 creates the well, denoted as wellbore, 116 in FIG. 1, which passes through various formation layers denoted by element number 118 towards target zone 160. A pump 130 circulates drilling fluid through a feed pipe 132 and downhole through the interior of drill string 108, through orifices in drill bit 124, back to the surface via annulus 119 around drill string 108, and into a retention pit 134. The drilling fluid transports cuttings from the wellbore 116 into the pit 134 and aids in maintaining the integrity of the wellbore 116.

The downhole drilling tool 120 includes tools that collect target well drilling data including survey trajectory data, formation properties and various other drilling conditions as the drill bit 114 extends the wellbore 116 into the subterranean formation 101 to target zone 160. The tools can include one or more logging while drilling (LWD) or measurement while drilling (MWD) tools 126 that collect measurements while drilling. The LWD/MWD tool 126 may include devices for measuring lithographic information such as formation resistivity and gamma ray intensity, devices for measuring the inclination and azimuth of the downhole drilling tool 120, pressure sensors for measuring drilling fluid pressure, temperature sensors for measuring wellbore temperature, etc. The downhole drilling tool 120 can also make project ahead measurements that are used to identify hazards and avoid collisions. A resistivity tool can be used to generate an electromagnetic signal for obtaining the look ahead measurements. The collected measurements can be used to identify a position of the downhole drilling tool 120 in the subterranean formation 101 to avoid potential collisions with underground hazards, such as man-made, natural, or defined hazards. The man-made and natural hazards can be considered real, tangible hazards.

The downhole drilling tool 120 may also include a telemetry module 128. The telemetry module 128 receives measurements provided by various downhole sensors, e.g., sensors of the LWD/MWD tool 126, and transmits the measurements to an autonomous steering system 140. Similarly, data provided by the autonomous steering system 140 is received by the telemetry module 134 and transmitted to the downhole drilling tool 120 and its tools, e.g., the LWD/MWD tool 126 and the downhole motor 121. In some examples, mud pulse telemetry, wired drill pipe, acoustic telemetry, or other telemetry technologies known in the art may be used to provide communication between the autonomous steering system 140 and the telemetry module 128.

The downhole motor 121 includes a housing 122 disposed about a steerable shaft 123. In this example, the steerable shaft 123 transfers rotation through the downhole motor 121. A deflection or cam assembly surrounding the shaft 123 is rotatable within the rotation resistant housing 122 to orient the deflection or cam assembly such that the shaft 123 can be positioned in the wellbore causing a change in trajectory. The downhole motor 121 may include or be coupled to directional sensors (e.g., a magnetometer, gyroscope, accelerometer, etc.) for determination of its state, e.g., azimuth and inclination with respect to a reference direction and reference depth.

The downhole motor 121 is configured to change the direction of the downhole drilling tool 120 and/or the drill bit 124, based on control inputs, e.g., steering commands, from the autonomous steering system 140. The autonomous steering system 140 provides the steering commands according to a planned well path from a well plan for drilling to the target zone 160. The autonomous steering system 140 can update the well plan to create a modified well plan for steering as disclosed herein to avoid collisions. The modified well plan can be updated in real time as the wellbore 116 is being drilled to drill within a safe corridor. The autonomous steering system 140, or at least a portion thereof, can be implemented on one or more computing devices. The one or more computing devices can include an interface, a memory, a processor, and a screen for displaying data. The screen can be an interactive touch screen. The autonomous steering system 140 can be, for example, autonomous steering system 200 of FIG. 2. It is understood that the placement of the autonomous steering system 140 is not limited to at or near the surface and may be located downhole, e.g., within the downhole drilling tool 120 near the downhole motor 121. A portion of the functionality may be remotely located via a communications network.

FIG. 1 depicts an onshore operations. Those skilled in the art will understand that the disclosure is equally well suited for use in offshore operations. FIG. 1 also depicts a specific wellbore configuration, those skilled in the art will understand that the disclosure is equally well suited for use in wellbores having other orientations including vertical wellbores, horizontal wellbores, slanted wellbores, multilateral wellbores, and other wellbore types.

Figure 2:
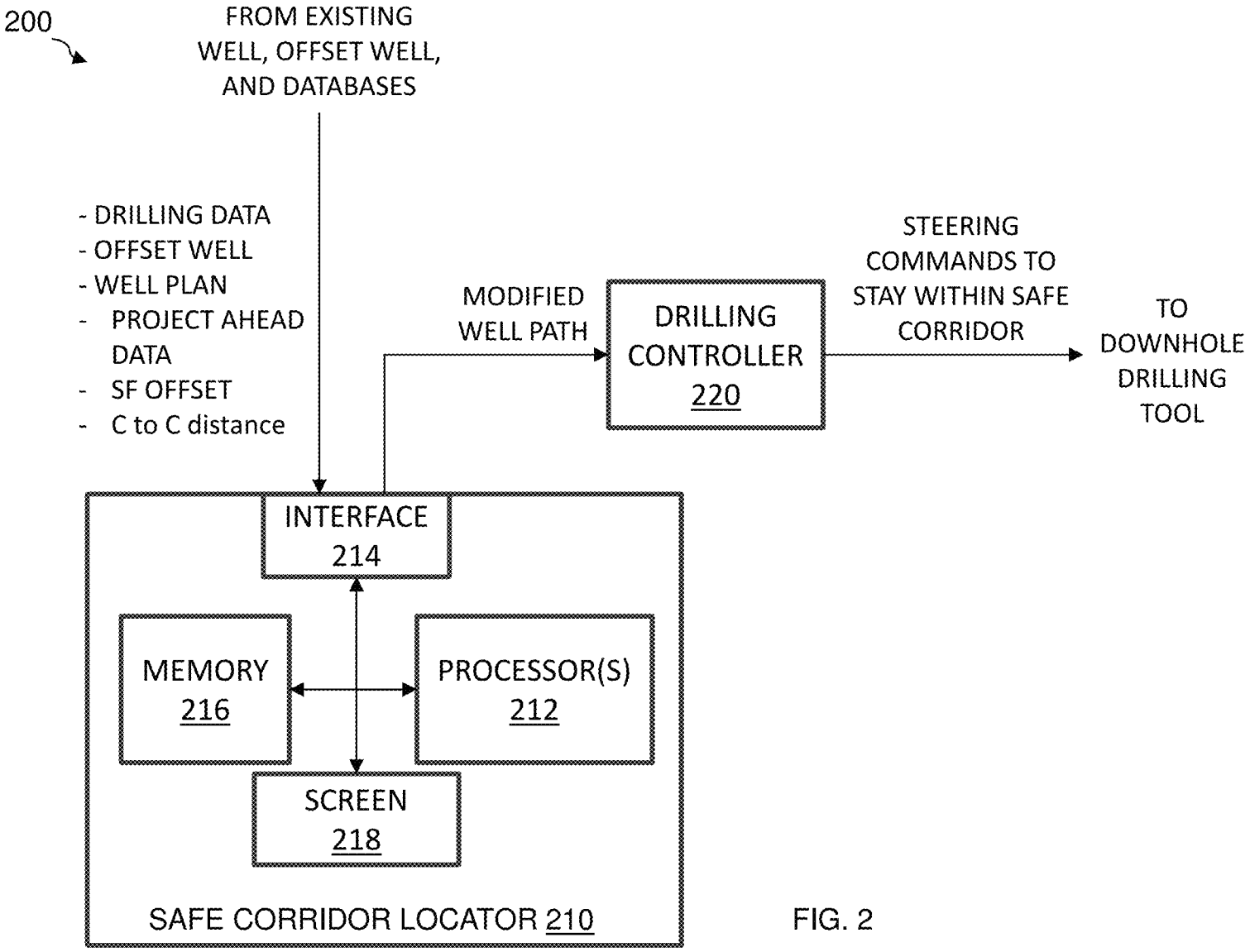
FIG. 2 illustrates a block diagram of an example of an autonomous steering system constructed according to the principles of the disclosure.

FIG. 2 illustrates a block diagram of an example of an autonomous steering system 200, such as autonomous steering system 140 in FIG. 1, which is constructed according to the principles of the disclosure. The autonomous steering system 200 directs the steering of a drill bit, such as drill bit 124, according to a well plan. The autonomous steering system 200 includes a safe corridor locator (SCL) 210 and a drilling controller 220. One skilled in the art will understood that although not shown, the autonomous steering system 200 may include other components of a directional drilling system.

The SCL 210 is configured to determine a modified well path to avoid hazards while drilling and also maintain the well plan. The modified well path can then be used by drilling controller 220 for automated steering of a downhole drilling tool. The drilling controller 220 can send steering commands to the downhole drilling tool to keep the drill bit within a safe corridor (or corridors). The drilling controller 220 can be configured to generate steering commands based on an input well path. The SCL 210 includes one or more processors, represented by processor 212, an interface 214, and a memory 216 that are communicatively connected to one another using conventional means. The drilling controller 220 can also include one or more interface, one or more processors, and one or more memory. Either the SCL 210, the drilling controller 220, or both can also include a screen to provide a visual representation, such as provided in step 360 of method 300. In FIG. 2, the SCL 210 includes screen 218 as an example. The visual representation can show the difference between the original well path and a modified well path. More than one modified well path may be shown.

The processor 212 is configured to automatically determine a modified path for a well, such as wellbore 116, in a subterranean formation to avoid one or more hazards. The processor 212 can operate according to an algorithm corresponding to at least some of the steps of the method 300 in FIG. 3. The algorithm can be represented as a series of operating instructions stored on the memory 216. The algorithm can be a machine learning algorithm.

The processor 212 may be a data processing unit, such as a central processing unit (CPU) or a graphics processing unit (GPU). It is understood that the number of interfaces, memories, or processors and the configuration that can be used for the SCL 210 is not limited as illustrated. For example, multiple memories and processors can be used for the SCL 210.

The interface 214 receives and transmits data of the SCL 210. The interface 214 receives different types of data, collectively referred to as well data. The well data includes look ahead data for collision avoidance, offset well data, SF offset input(s), real-time drilling data (e.g., survey data), and the well plan or at least a portion of the well plan that includes the planned well path. The survey data can be used to determine the actual position of the downhole drilling tool in the subterranean formation and the look ahead data, which can include measurements at the drill bit, can be used with a project ahead feature to determine possible collisions. The survey data associated with the well being drilled can be received in real time during drilling. For example, the survey data can be real time sensor measurements from various downhole sensors, e.g., sensors of a MWD or LWD tool and/or directional sensors. The survey data can be obtained every 100 feet and azimuth data obtained every ten feet. A near bit sensor can be used to obtain the project ahead data. The offset well data can be historical data from a database or other data storage device. At least some of the data received via the interface 214 can be stored on the memory 216. The interface 214 forwards the received data to the processor 212 and transmits an output of the SCL 210. As illustrated in FIG. 2, the output can be a modified well path. The interface 214 transmits the modified well path to drilling controller 220. The interface 214 may be implemented using conventional circuitry and/or logic for communicating using protocols common in the industry.

Figure 3:
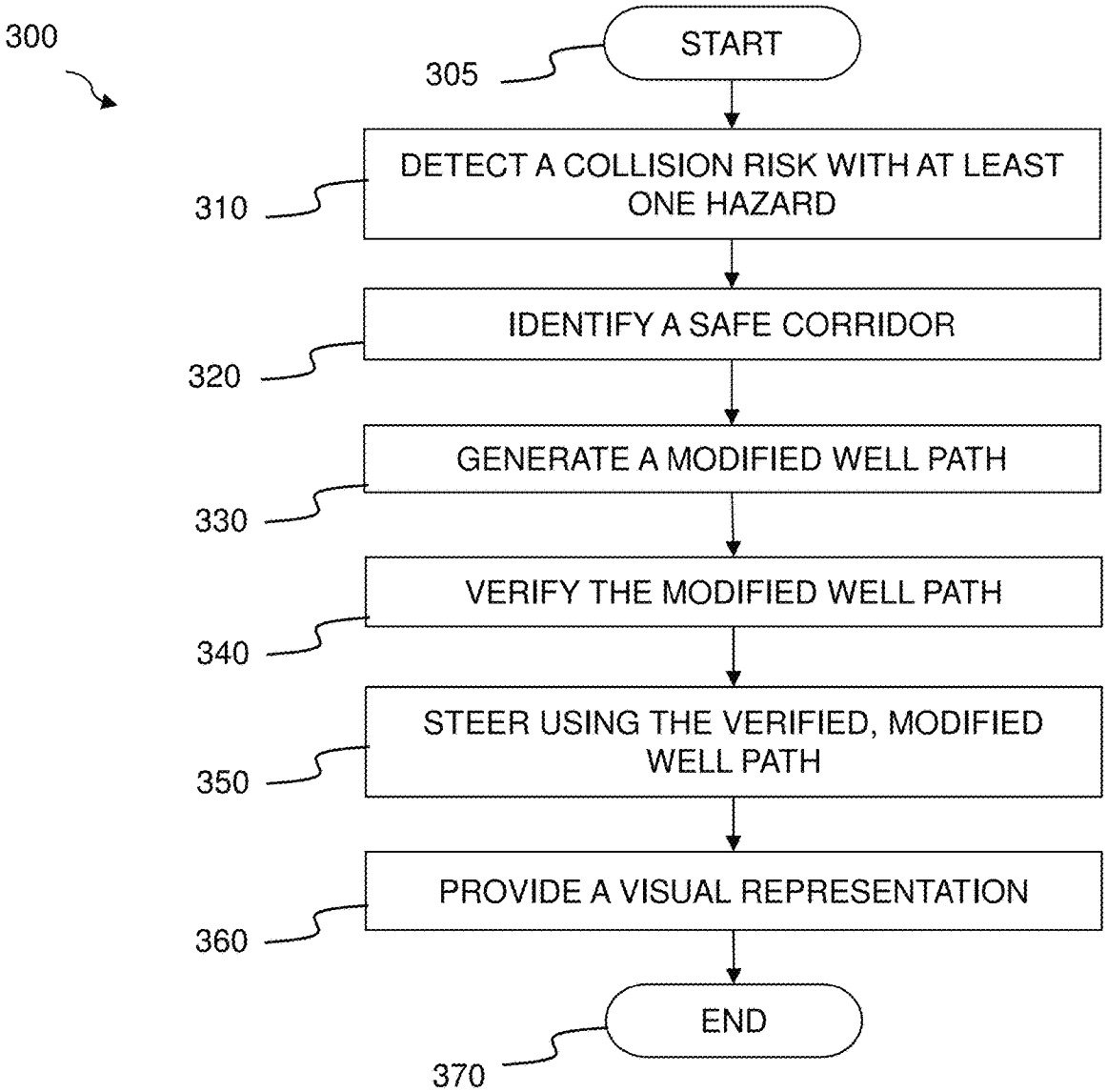
FIG. 3 illustrates a flow diagram of an example of an automated method 300 of drilling a wellbore carried out according to the principles of the disclosure.

The memory 216 can be a non-transitory memory that stores data, e.g., real time sensor measurements, well plan data, historical data, etc., which is needed in performing the proposed methodology, e.g., 300 in FIG. 3. The memory 216 also stores a series of instructions that when executed, causes the processor 212 to perform operations that include identifying a corridor (or corridors) that avoids a hazard or hazards, modifying a well path using the corridor based on the hazards, and automatically steering a downhole drilling tool according to the modified path. The memory 216 may be a conventional memory device such as flash memory, ROM, PROM, EPROM, EEPROM, DRAM, SRAM and etc.

FIG. 3 illustrates a flow diagram of an example of an automated method 300 of drilling a wellbore carried out according to the principles of the disclosure. Method 300 is an anti-collision monitoring and adapting method that operates in real time and provides automated steering for wellbore avoidance. At least a portion of the method 300 can be directed by one or more algorithms directed to autonomous steering such as disclosed herein and represented as a series of operating instructions that direct the operation of a processor. One or more of the steps of method 300 can be carried out by an autonomous steering system, such as autonomous steering systems 140 or 200. Method 300 starts in step 305 with receiving well data. In step 310, a risk of a collision of a path of a wellbore in a subterranean formation with at least one hazard is detected. The wellbore is presently being drilled by steering a downhole drilling tool according to the path and the path is originally a planned path based on a well plan for the wellbore. The risk of collision, or collision risk, with one or more hazards can be based on the path and a project ahead feature, such as a radial scan. A separation factor can be used with the radial scanning for detecting a collision risk. When a constraint, the hazard can be synthetically represented and used with the path to determine a collision risk. The collision risk can be represented by different drilling zones, such as a green zone, yellow zone, and red zone as noted herein. Different actions can be associated with the different types of collision risks. The different actions for modifying the well path can also consider the type of hazard. FIGS. 4 and 5 provide an example of detecting a risk and modifying the path when needed based on the collision risk.

In step 320, a corridor (a safe corridor) is identified for the wellbore to avoid the at least one hazard. Identifying the corridor can use real-time positioning of the wellbore in the subterranean formation. The separation factor can also be used when identifying the corridor. The identified corridor can still be part of the well plan. For example, in FIG. 4 a collision risk is identified but determined that the planned path provides a safe corridor. In FIG. 5, however, a collision risk is identified and corridor is identified to avoid a collision.

The path that is presently being used is modified in step 330 to create a modified path that incorporates the corridor. The modified path can still comply with the well plan. For example, the modified path can avoid a collision, return to the planned path after the collision risk is gone (or greatly reduced), and continue to the target. FIG. 5 illustrates an example of identifying a corridor to avoid a collision and still reach the target.

In step 340, the modified path is verified to ensure a collision are avoided with the at least one hazard. Verifying the modified path provides a Quality Assurance or Quality Control check before continuing with automated steering. The modified path can be verified using, for example, a project ahead system.

The downhole drilling tool is steered according to a verified modified path in step 350. A drilling controller, such as drilling controller 220, can be used to issue steering commands based on the modified path. Each of the steps 305 to 350 can be automatic steps performed by one or more processors and can be performed in real time.

A visual representation of the planned path and modified path with respect to the at least one hazard can be provided in step 360. The visual representation can be a Heads-Up Display on a screen of a computing device used for the autonomous steering system. The visual representation can be provided throughout the drilling process. A user may interact and manipulate the visual representation, such as zoom in and out, highlight a section, focus on a safe corridor, etc.

Method 300 continues during drilling of the wellbore until the target zone is reached and drilling stops in step 370. During the drilling operation, multiple hazards can be identified and avoided according to method 300.

FIG. 4 illustrates an overhead view of an example of a cluster of existing wells and a representative well, wellbore 116 of FIG. 1, which is in the process of being drilled from well system 100 at the surface to a target zone 160 in the subterranean formation 101 according to the principles of the disclosure. Wellbore 116 is being drilled according to a well path that corresponds to a planned well path. At point A, a collision risk is identified with a hazard, which is a defined buffer zone 410 around an existing wellbore 420. The collision risk with the soft hazard buffer zone 410 is identified as a yellow zone and drilling of wellbore 116 continues along the well path with caution and close monitoring to determine if the well path needs to be modified. In this example the well path is not modified and the wellbore 116 is drilled along the well path to the target zone 160.

FIG. 5 illustrates another overhead view of the example of existing wells and representative well, wellbore 116 of FIG. 1. In this example, wellbore 116 is again being drilled from well system 100 at the surface to target zone 160 according to a well path that corresponds to a planned well path. At point B, a collision risk is identified with a hazard, which is existing wellbore 420. The collision risk with the wellbore 420 is identified as a red zone and a corridor identified to avoid the wellbore 420. The path to the target 160 is changed using a corridor to avoid a collision with the wellbore 420. Accordingly, unlike FIG. 4, in the example of FIG. 5 the well path is modified and the wellbore 116 is drilled along the well path to the target zone 160.

A portion of the above-described apparatus, systems or methods may be embodied in or performed by various analog or digital data processors, wherein the processors are programmed or store executable programs of sequences of software instructions to perform one or more of the steps of the methods. A processor may be, for example, a programmable logic device such as a programmable array logic (PAL), a generic array logic (GAL), a field programmable gate arrays (FPGA), or another type of computer processing device (CPD). The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed examples or embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include, but are not limited to: magnetic media such as hard disks, floppy disks, and magnetic tape; optical media such as CD-ROM disks; magneto-optical media such as floppy disks; and hardware devices that are specially configured to store and execute program code, such as ROM and RAM devices. Configured or configured to means, for example, designed, constructed, or programmed, with the necessary logic and/or features for performing a task or tasks. Examples of program code include both machine code, such as produced by a compiler, and files containing higher level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions and modifications may be made to the described embodiments. It is also to be understood that the terminology used herein is for the purpose of describing particular embodiments only, and is not intended to be limiting, because the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of the exemplary methods and materials are described herein.

As noted in the Summary, aspects disclosed herein include:

A. An automated method of drilling a wellbore, including: (1) detecting a collision risk of a path of a wellbore in a subterranean formation with at least one hazard, wherein the wellbore is being drilled by steering a downhole drilling tool according to the path and the path is based on a well plan for the wellbore, (2) identifying a corridor for the wellbore to avoid the at least one hazard, (3) modifying the path by incorporating the corridor, and (4) steering the downhole drilling tool according to the modified path, wherein the detecting, the identifying, the modifying, and the steering are automatically performed in real-time.

B. An autonomous steering system, comprising: (1) an interface to receive well data, and (2) one or more processor to perform operations that include: (2A) detecting a collision risk of a path of a wellbore in a subterranean formation with at least one hazard, wherein the wellbore is being drilled by steering a downhole drilling tool according to the path and the path is based on a well plan for the wellbore, (2B) identifying a corridor for the wellbore to avoid the at least one hazard, (2C) modifying the path by incorporating the corridor, and (2D) steering the downhole drilling tool according to the modified path, wherein one or more of the detecting, the identifying, the modifying, and the steering are automatically performed in real-time.

C. A computer program product having a series of operating instructions stored on a non-transitory computer readable medium that direct the operation of a processor when initiated to perform operations including: (1) detecting a collision risk of a path of a wellbore in a subterranean formation with at least one hazard, wherein the wellbore is being drilled by steering a downhole drilling tool according to the path and the path is based on a well plan for the wellbore, (2) identifying a corridor for the wellbore to avoid the at least one hazard, (3) modifying the path by incorporating the corridor, and (4) steering the downhole drilling tool according to the modified path, wherein one or more of the detecting, the identifying, the modifying, and the steering are automatically performed in real-time.

Each of the disclosed aspects in A, B, and C can have one or more of the following additional elements in combination. Element 1: wherein the identifying uses a real-time positioning of the wellbore in the subterranean formation. Element 2: wherein the detecting includes radially scanning from the downhole drilling tool and identifying a separation factor associated with the at least one hazard. Element 3: wherein the identifying the corridor is based on a separation factor. Element 4: wherein the hazard is an adjacent well. Element 5: wherein the downhole drilling tool is a bottom hole assembly (BHA). Element 6: further comprising verifying the modified path avoids collision with the at least one hazard and performing the steering step after the verifying. Element 7: further comprising providing a visual representation of the planned path and modified path with respect to the at least one hazard. Element 8: wherein the modified path complies with the well plan. Element 9: wherein the identifying uses a real-time positioning of the wellbore in the subterranean formation. Element 10: wherein performing the identifying, the modifying, and the steering are based on the collision risk. Element 11: wherein the identifying the corridor is based on a separation factor. Element 12: wherein the identifying and the modifying are based on the type of at least one hazard. Element 13: wherein the at least one hazard is a man-made hazard, a geological hazard, or a defined hazard. Element 14: wherein the operations further include verifying the modified path avoids collision with the at least one hazard and performing the steering step after the verifying. Element 15: further comprising a screen that provides a visual representation of the planned path and modified path with respect to the at least one hazard. Element 16: wherein the operations further include verifying the modified path avoids collision with the one or more hazards and performing the steering after the verifying.

What is claimed is:

1. An automated method of drilling a wellbore, comprising:

detecting, based on a separation factor, different types of collision risks of a path of a wellbore in a subterranean formation with at least one hazard, wherein the wellbore is being drilled by steering a downhole drilling tool according to the path and the path is based on a well plan for the wellbore;

displaying different types of drilling zones, wherein each of the different types of drilling zones correlates to one of the different types of the collision risks and is displayed via one of multiple types of visual representations that uniquely correspond to each of the different types of collision risks, wherein the at least one hazard is located within a first one of the different types of drilling zones and a second one of the different types of drilling zones is outside of the separation factor and includes no hazards;

identifying a corridor within the second one of the different types of drilling zones for the wellbore to avoid at least the first one of the different types of drilling zones;

modifying the path by incorporating the corridor and considering a type of the collision risk;

displaying the modified path that is within the second one of the different types of drilling zones; and steering the downhole drilling tool according to the modified path, wherein the detecting, the identifying, the modifying, and the steering are automatically performed in real-time.

2. The automated method as recited in claim 1, wherein the identifying uses a real-time positioning of the wellbore in the subterranean formation.

3. The automated method as recited in claim 1, wherein the detecting includes radially scanning from the downhole drilling tool using the separation factor, wherein the separation factor is associated with the at least one hazard.

4. The automated method as recited in claim 1, further comprising synthetically representing the at least one hazard and automatically detecting the collision risk using the synthetic representation.

5. The automated method as recited in claim 1, wherein the hazard is an adjacent well.

6. The automated method as recited in claim 1, wherein the downhole drilling tool is a bottom hole assembly (BHA).

7. The automated method as recited in claim 1, further comprising verifying the modified path avoids collision with the at least one hazard and performing the steering step after the verifying.

8. The automated method as recited in claim 1, further comprising displaying the planned path.

9. The automated method as recited in claim 1, wherein the modified path complies with the well plan.

10. An autonomous steering system, comprising:

an interface to receive well data; and one or more processors to perform operations including:

detecting, based on a separation factor, a collision risk of a path of a wellbore in a subterranean formation with at least one hazard, wherein the wellbore is being drilled by steering a downhole drilling tool according to the path and the path is based on a well plan for the wellbore;

displaying different types of drilling zones, wherein each of the different types of drilling zones correlates to one of the different types of the collision risks and is displayed via one of multiple types of visual representations that uniquely correspond to each of the different types of collision risks, wherein the at least one hazard is located within a first one of the different types of drilling zones and a second one of the different types of drilling zones is outside of the separation factor and includes no hazards;

identifying a corridor within the second one of the different types of drilling zones for the wellbore to avoid at least the first one of the different types of drilling zones;

modifying the path by incorporating the corridor and considering a type of the collision risk;

displaying the modified path that is within the second one of the different types of drilling zones; and steering the downhole drilling tool according to the modified path, wherein one or more of the detecting, the identifying, the modifying, and the steering are automatically performed in real-time.

11. The autonomous steering system as recited in claim 10, wherein the identifying uses a real-time positioning of the wellbore in the subterranean formation.

12. The autonomous steering system as recited in claim 10, wherein performing the identifying, the modifying, and the steering are based on the type of the collision risk.

13. The autonomous steering system as recited in claim 10, wherein the displaying further includes displaying the planned path.

14. The autonomous steering system as recited in claim 10, wherein the identifying and the modifying are further based on the type of the at least one hazard.

15. The autonomous steering system as recited in claim 10, wherein the at least one hazard is a defined constraint.

16. The autonomous steering system as recited in claim 10, wherein the operations further include verifying the modified path avoids collision with the at least one hazard and performing the steering step after the verifying.

17. The autonomous steering system as recited in claim 13, further comprising a screen for the displaying of the planned path, the modified path, and the first and second ones of the different types of drilling zones.

18. The autonomous steering system as recited in claim 10, wherein the modified path complies with the well plan.

19. A computer program product having a series of operating instructions stored on a non-transitory computer readable medium that direct the operation of a processor when initiated to perform operations including:

determining, using one or more separation factors, presence of one or more hazards along a path of a wellbore in a subterranean formation, wherein the wellbore is being drilled by steering a downhole drilling tool according to the path and the path is based on a well plan for the wellbore;

modifying the path when the one or more hazard is present and based on a type of a risk of different types of collision risks with the one or more hazard and the one or more separation factors;

displaying the modified path and different types of drilling zones, wherein each of the different types of drilling zones correlates to one of the different types of the collision risks and is displayed via one of multiple types of visual representations that uniquely correspond to each of the different types of collision risks, wherein at least one of the different types of drilling zones includes no hazards and the modified path; and steering the downhole drilling tool according to the modified path, wherein one or more of the determining, the modifying, and the steering are automatically performed in real-time.

20. The computer program product as recited in claim 19, wherein the operations further include verifying the modified path avoids collision with the one or more hazards and performing the steering after the verifying.

* * * * *